US006128252A

United States Patent [19]

Nosaka

[11] Patent Number: 6,128,252

[45] Date of Patent: Oct. 3, 2000

[54] ELECTRONIC WATCH WITH AUTOCALENDAR

[75] Inventor: Naokatsu Nosaka, Chiba, Japan

[73] Assignee: Seiko Instruments Inc., Japan

[21] Appl. No.: 09/248,257

[22] Filed: Feb. 11, 1999

[30] Foreign Application Priority Data

Feb. 12, 1998 [JP] Japan ..... 10-030118

[51] Int. Cl.[7] ..... G04B 19/24

[52] U.S. Cl. ..... 368/28; 368/31; 368/33; 368/34

[58] Field of Search ..... 368/28, 31, 34, 368/35

[56] References Cited

U.S. PATENT DOCUMENTS

| | | | |
|---|---|---|---|
| 4,573,127 | 2/1986 | Korff | 368/28 |
| 4,632,569 | 12/1986 | Gogniat | 368/35 |
| 5,305,289 | 4/1994 | Besson et al. | 368/28 |
| 5,357,492 | 10/1994 | sagame | 368/10 |

*Primary Examiner*—Bernard Roskoski

*Attorney, Agent, or Firm*—Adams & Wilks

[57] ABSTRACT

When an analog indicator is enabled, the position of the time indicator is detected by an indicator position detection circuit. When the indicator arrives at a predetermined position, typically 24:00, a CPU advances calendar data to a correct date and stores the calculation result in a calendar counter. The CPU outputs a drive instruction signal to a date-indicating wheel drive pulse generating circuit to drive a date-indicating wheel to the correct date. The date-indicating wheel drive pulse generating circuit then drives the date-indicating wheel to a renewed position. At this time, a time counter is cleared to 0:00 and is synchronized with the position of the analog indicator. When driving of the analog indicator is disabled, such as by the pulling out of a crown switch, and the time counted by the time counter arrives at a predetermined time, typically 24:00, the CPU advances the present calendar data to the correct date and stores the calculation result in the calendar counter. The CPU outputs a drive instruction signal to the date-indicating wheel drive pulse generating circuit to drive the date-indicating wheel to indicate the correct date. The date-indicating wheel drive pulse generating circuit then drives the date-indicating wheel to the correct date. At this time, the time counter is cleared to 0:00.

15 Claims, 3 Drawing Sheets

ELECTRONIC WATCH WITH AUTOCALENDAR

BACKGROUND OF THE INVENTION

1. Field of the Invention

The present invention relates to an electronic watch having a CPU. Particularly, the invention relates to an electronic watch with an autocalendar function in which manual correction of the end date of a month is unnecessary.

2. Description of the Prior Art

Conventionally, in an electronic watch with an autocalendar function, a crown is pulled out to stop the movement of an analog indicator, and during the period of time, calendar data is not renewed but is held, and even if more than one day elapses, the calendar data is not renewed, and a date-indicating wheel remains stopped. This results from the fact that a date-indicating wheel is mechanically moved while being connected with the movement of an analog indicator.

However, there has been a problem that in a conventional watch with autocalendar function in which the correction of the end of the month is unnecessary, if the watch is left in the state where the movement of an analog indicator stops, data of month held inside of the watch becomes late, and further, judgement of a leap year becomes impossible, so that it becomes necessary to input data of calendar data again.

SUMMARY OF INVENTION

In order to solve the foregoing problem, according to the present invention, when an indicator movement is stopped by an instruction from a CPU, renewal of calendar data is changed to that by a counter separately provided inside of a watch, and every 24 hours of this counter, the calendar data is renewed and a date is advanced. In the case where the indicator movement of an analog indicator is started, at an arbitrary position of the analog indicator, that is, at 24:00, the calendar data is renewed and a date is advanced. At this time, the counter inside of the watch is cleared (0:00), so that a shift between the arbitrary position of the analog indicator and the counter in the inside is corrected.

BRIEF DESCRIPTION OF THE DRAWINGS

A preferred form of the present invention is illustrated in the accompanying drawings in which.

DETAILED DESCRIPTION OF THE PREFERRED EMBODIMENTS

Figure 1:
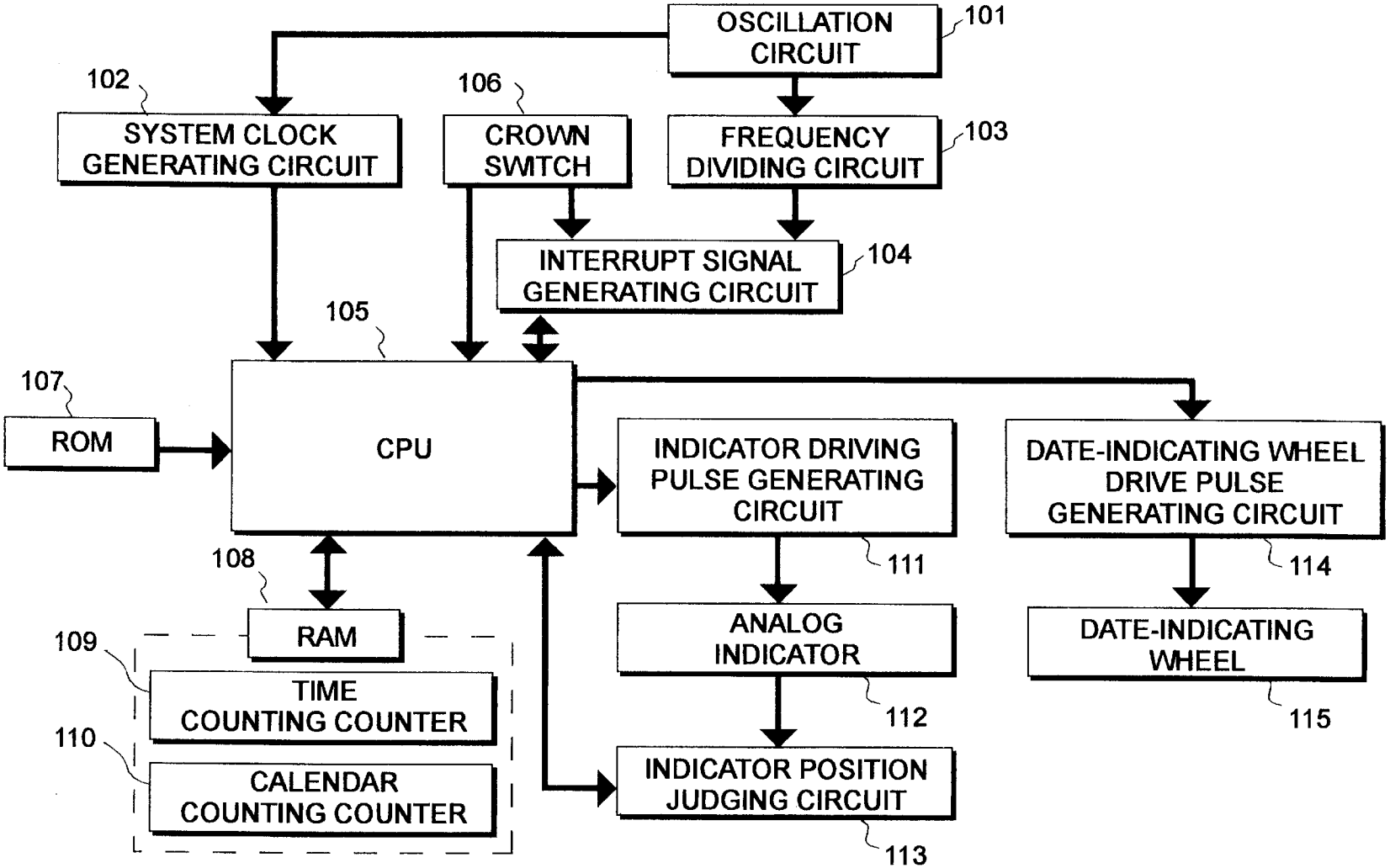
FIG. 1 is a functional block diagram showing the structure of an electronic watch with autocalendar according to the present invention.

FIG. 1 is a functional block diagram showing a typical structure of the present invention. In FIG. 1, an output of an oscillation circuit 101 is inputted to a system clock generating circuit 102, which generates a system clock to drive a CPU 105 performing various arithmetic processes. Moreover, an output of the oscillation circuit 101 is inputted to a frequency dividing circuit 103, and by a signal obtained through frequency division of the frequency dividing circuit 103, an interrupt signal generating circuit 104 is operated and generates an interrupt signal to the CPU 105. The interrupt signal generating circuit 104 is also operated by an output signal generated by the operation of a crown switch 106, and generates the interrupt signal to the CPU 105.

The CPU 105 enters into an interrupt operation by the interrupt signal from the interrupt signal generating circuit 104, and in accordance with procedures programmed in a ROM 107, the CPU 105 performs various arithmetic processes. A RAM 108 stores various data calculated by the CPU 105.

In the RAM 108, a time counting counter 109, which shows the present time calculated by the CPU 105 when the interrupt signal is generated by the output of the frequency dividing circuit 103, is stored. Moreover, in the RAM 108, a calendar counting counter 110, which shows the present date calculated by the CPU on the basis of information from the time counting counter 109 or an indicator position judgement circuit 113, is stored. This time counting counter 109 and the calendar counting counter 110 can also be realized by providing counters other than the RAM.

The CPU 105 performs arithmetic processes when the interrupt signal is generated by the from the frequency dividing circuit 103, and outputs an indicator drive instruction signal to an indicator drive pulse generating circuit 111. An analog indicator 112 such as an indicator of days, hours, minutes and seconds is driven by a drive pulse from the indicator drive pulse generating circuit 111. When the analog indicator 112 is driven, an indicator position detecting circuit 113 detects the present indicator position. When the present indicator position comes to an arbitrary position, normally 24:00, the CPU 105 makes a determination to advance the present calendar data by one day, and stores the calculation result in the calendar counting counter 110. The CPU 105 outputs a drive instruction signal ranging over a renewed calendar data position to a date-indicating wheel drive pulse generating circuit 114. A date-indicating wheel 115 is moved to a renewed day position by a date-indicating wheel drive pulse from the date-indicating wheel drive pulse generating circuit 114. At this time, the time counting counter 109 is cleared to 0:00, and is synchronized with the position of the analog indicator 112.

When the crown switch 106 is operated and is pulled out, an interrupt signal is generated by the interrupt signal generating circuit 104. The CPU performs an interrupt process upon receipt of this interrupt signal, and when the CPU judges that the crown switch 106 is pulled out, the CPU stops providing the indicator drive instruction signal to the indicator drive pulse generating circuit 111. When the CPU 105 stops driving the analog indicator 112, and when the time counting counter 110 arrives at a predetermined arbitrary time, normally 24:00, the CPU 105 performs calculation to advance the present calendar data by one day, and stores the calculation result in the calendar counting counter 110. The CPU 105 outputs the drive instruction signal ranging over the renewed calendar data position to the date-indicating wheel drive pulse generating circuit 114. By the date-indicating wheel drive pulse from the date-indicating wheel drive pulse generating circuit 114, the date-indicating wheel 115 is moved to the position of a renewed date. At this time, the time counting counter 109 is cleared to 0:00 as an initial value of the start of indicator movement.

When the crown switch 106 is operated and is pushed in, an interrupt signal is generated from the interrupt signal generating circuit 104. The CPU 105 performs an interrupt process by this interrupt signal, and when judging that the crown switch 106 is pushed in, the CPU 105 restarts the output of the indicator drive instruction signal to the indicator drive pulse generating circuit 111. At this time, the time counting counter 109 is cleared to 0:00.

Figure 2:
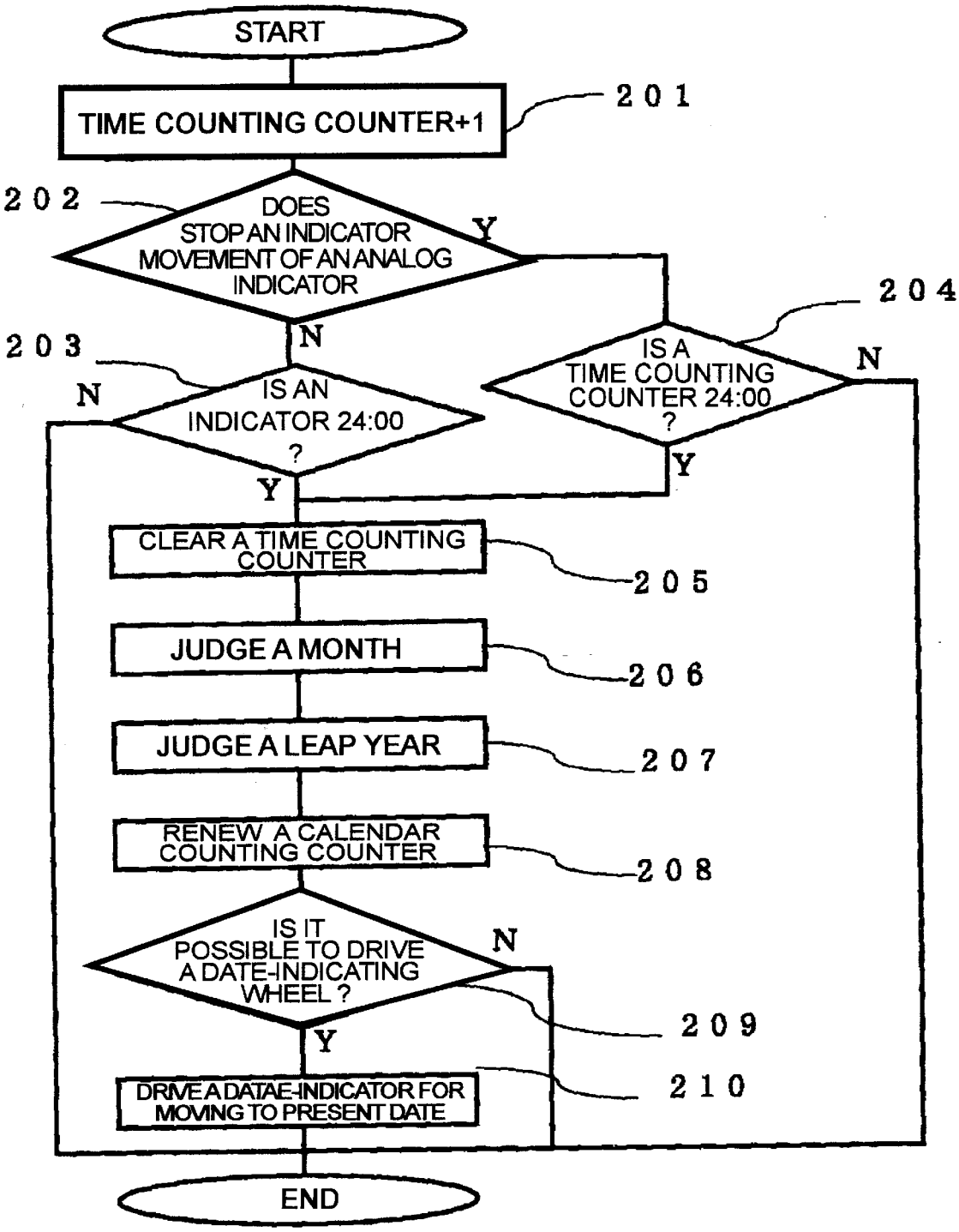
FIG. 2 is a flow chart showing a switching process between the renewal of calendar data by a position of an analog indicator of an electronic watch with autocalendar of the present invention and the renewal of calendar data by a time counting counter.

FIG. 2 is a flow chart showing a switching process between the renewal of calendar data by the position of the analog indicator and the renewal of calendar data by the time counting counter 109. When the interrupt signal generated by means of the output signal from the frequency dividing circuit 103 is inputted to the CPU 105, the CPU 105 performs an interrupt arithmetic process programmed in the ROM 107. First, the time information of the time counting counter 109 is advanced (201), and it is confirmed whether the analog indicator 112 stops the indicator 112 movement (202). If the analog indicator is in the indicator 112 movement, it is confirmed whether the present analog indicator position is 24:00 (203). If the position of the analog indicator is not 24:00, the process is ended. If the position of the analog indicator 112 is 24:00, the time counting counter is cleared to 0:00 (205). Next, in order to renew the calendar data, it is judged what month it is now (206), and it is judged whether the present year is a leap year (207). On the basis of the month and year information, the calendar data are advanced and the data of the calendar counting counter 110 is renewed (208). A voltage of a battery or the like is confirmed, and if it is impossible to drive the date-indicating wheel 115 by some reason, the process is ended (209). If it is possible to drive the date-indicating wheel 115, the date-indicating wheel 115 is moved to the renewed calendar data position (210) and the process is ended.

If the indicator 112 movement of the analog indicator is stopped (202), the renewed data of the time counting counter 109 is confirmed, and if the present time is 24:00, the data of the time counting counter 109 is cleared to 0:00 (205), and the steps following the above (206) are carried out. In the case where the data of the time counting counter 109 are not 24:00, the process is ended.

Figure 3:
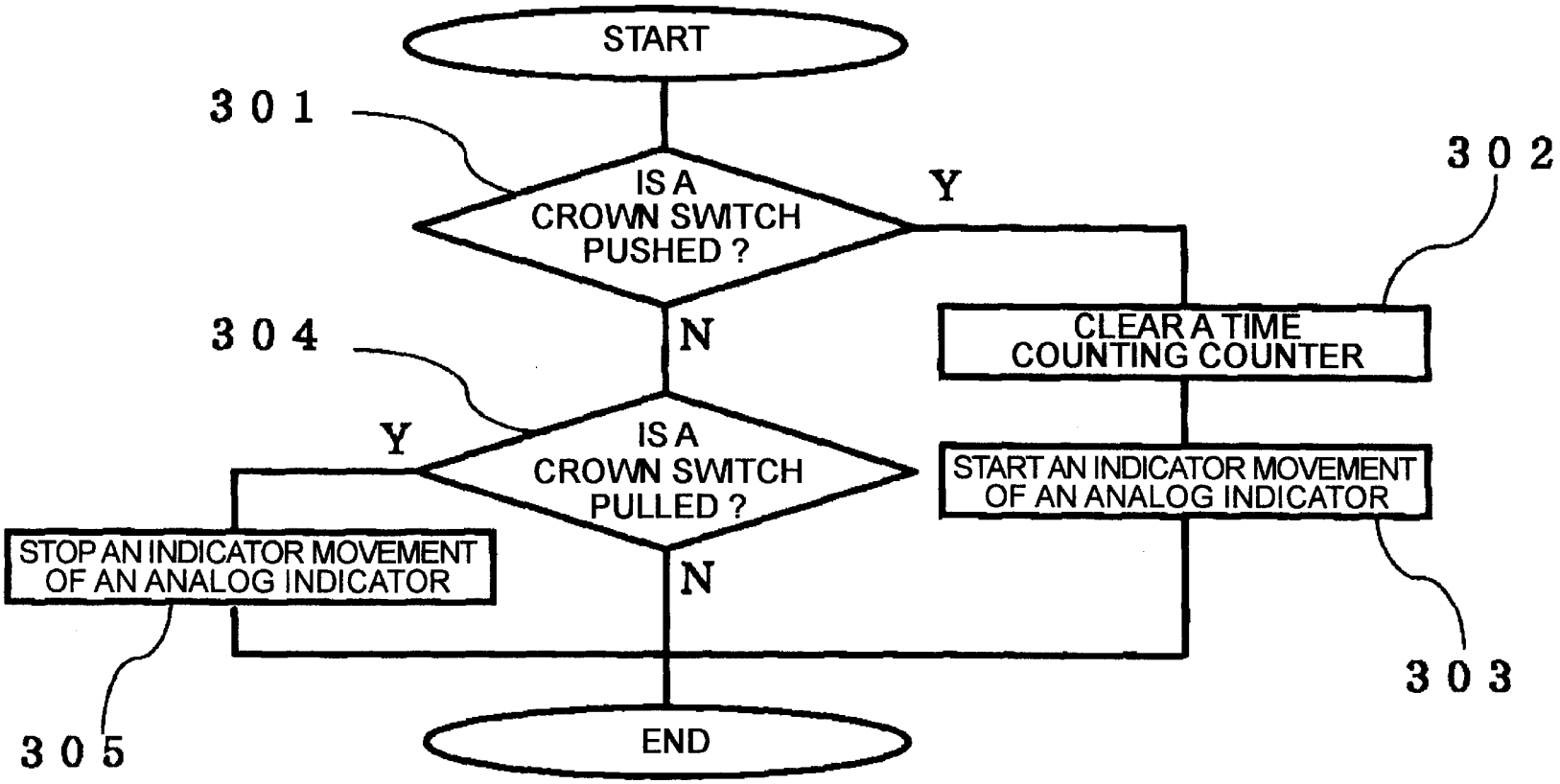
FIG. 3 is a flow chart showing an interrupt arithmetic process in the case where an interrupt signal is inputted to a CPU by an operation signal from a crown switch of an electronic watch with autocalendar of the present invention.

FIG. 3 is a flow chart showing an interrupt arithmetic process in the case where an interrupt signal is inputted from the interrupt generating circuit 104 to the CPU 105 by means of an operation signal from the crown switch 106. The state of the crown switch 106 is confirmed, that is, it is confirmed whether the crown switch 106 is pushed in (301).

If the crown switch 106 is pushed in, it is judged that the indicator movement of the analog indicator 112 of the watch is started, and the data of the time counting counter 109 is cleared to 0:00 (302). Then the indicator movement of the analog indicator 112 is started (303) and the process is ended. If the crown switch 106 is not pushed in (301), it is confirmed whether the crown switch 106 is pulled out (304), and if the crown switch 106 is pulled out, the indicator movement of the analog indicator 112 is stopped (305) and the process is ended.

According to the electronic watch with autocalendar function of the present invention, in the case where an analog indicator is operated, when the analog indicator comes to an predetermined arbitrary time position, a date-indicating wheel is driven to a position of a date counted by a calendar counting circuit, and an indicator drive pulse generating circuit is not operated, and in the case where the analog indicator is not operated, the date is clocked by a time counting circuit, and the date-indicating wheel is driven to the position of a date counted by the calendar counting circuit, so that the invention has an effect that even if the indicator movement of the analog indicator is stopped, a shift does not occur in a calendar display.

What is claimed is:

1. An electronic watch with autocalendar, comprising:

an oscillation circuit;

a frequency dividing circuit for dividing an output signal of the oscillation circuit and producing a divided output signal;

a system clock generating circuit for generating a CPU system clock based on an output signal of the oscillation circuit;

an external input switch for generating an operation signal in response to an external input;

interrupt signal generating means for generating an interrupt signal in response to a divided output signal from the frequency dividing circuit and an operation signal output by the external input switch;

a RAM for temporary data storage;

a ROM for storing a CPU control program;

a CPU for performing arithmetic processes in accordance with the CPU control program stored in the ROM;

time counting means for counting a time;

calendar counting means for counting calendar data;

an indicator drive pulse generating circuit for generating pulses for driving an analog indicator in response to an output of the CPU;

an analog indicator for indicating time, and being driven by an output signal of the indicator drive pulse generating circuit;

indicator position judgement means for judging the time indicated by the analog indicator by judging a position of the time indicating member of the analog indicator;

a date-indicating wheel drive pulse generating circuit for generating pulses for driving a date-indicating wheel in response to an output of the CPU; and a date-indicating wheel driven by an output signal of the date-indicating wheel drive pulse generating circuit;

wherein the CPU is responsive to the indicator position judgement means when the indicator drive pulse generating circuit is being operated and the analog indicator is being operated to indicate time so as to control the date-indicating wheel drive pulse generating circuit to drive the date-indicating wheel to a position to indicate a date counted by the calendar counting means when the analog indicator is in a predetermined position as detected by the indicator position judgement means; and wherein the CPU is responsive to the time counting means when the indicator drive pulse generating circuit is not being operated and the analog indicator is not being operated to indicate time, so as to control the date-indicating wheel drive pulse generating circuit to drive the date-indicating wheel to a position to indicate a date counted by the calendar counting means.

2. An electronic watch with autocalendar as recited in claim 1; wherein the CPU is responsive to the indicator position judgement means when the analog indicator is being operated by the drive pulses from the indicator drive pulse generating circuit such that when the analog indicator comes to an arbitrary time position as deleted by the indicator position judgement means, counting information of the time counting means is reset.

3. An electronic watch with autocalendar as recited in claim 1; wherein the CPU is responsive to an interrupt signal generated in response to an operation signal output by the external input switch during a period when the analog indicator is not being operated, to reset the count information of the time counting means and to control the indicator drive pulse generating circuit to generate drive pulses to drive the analog indicator.

4. An electronic timepiece comprising:

an analog display having a pulse-driven time indicating member for indicating time and a pulse-driven date indicating member for indicating a date;

display disabling means for disabling the analog display so that the time indicator and date indicator are stopped;

time counting means for counting time;

calendar counting means for counting calendar data;

drive pulse generating means for generating pulses for driving the time indicating member and the date indicating member;

indicator position judgement means for judging the time indicated by the analog display by judging a position of a time indicating member; and control means for controlling the drive pulse generating circuit;

wherein the control means is responsive to the indicator position judgement means when the analog display is enabled to control the drive pulse generating means to drive the date-indicating member to a position to indicate a date counted by the calendar counting means when the time indicating member is in a predetermined position as detected by the indicator position judgement means, and the control means is responsive to the time counting means when the analog display is disabled to control the drive pulse generating means to drive the date indicating member to a position to indicate a date counted by the calendar counting means.

5. An electronic timepiece according to claim 4; further comprising a reference signal generating circuit for generating a reference signal.

6. An electronic timepiece according to claim 4; wherein the reference signal generating circuit comprises an oscillator circuit, a frequency dividing circuit for dividing an output signal of the oscillation circuit and producing a divided output signal for use in determining the timing of pulses generated by the pulse generating circuit, and a system clock generating circuit for generating a system clock based on an output signal of the oscillation circuit.

7. An electronic timepiece according to claim 6; wherein the display disabling means comprises an external input switch for generating an operation signal in response to an external input.

8. An electronic timepiece according to claim 7; further comprising interrupt signal generating means for generating an interrupt signal in response to a divided output signal from the frequency dividing circuit and an operation signal output by the external input switch.

9. An electronic timepiece according to claim 8; wherein the control means is responsive to an interrupt signal generated in response to an operation signal output by the external input switch during a period when the analog indicator is disabled, to reset the count information of the time counting means and to control the drive pulse generating circuit to generate drive pulses to drive the time indicating member and the and date indicating member.

10. An electronic timepiece according to claim 4; wherein the control means comprises a CPU, a RAM for temporary data storage and a ROM for storing a CPU control program.

11. An electronic timepiece according to claim 4; wherein the drive pulse generating means comprises a time indicator drive pulse generating circuit for generating drive pulses for driving the time indicating member in response to an output of the control means and a date indicating member drive pulse generating circuit for generating drive pulses for driving the date indicating member in response to an output of the control means.

12. An electronic timepiece according to claim 4; wherein the time indicating member includes an analog indicator for indicating an hour, a minute and a second.

13. An electronic timepiece according to claim 4; wherein the date indicating member comprises a date-indicating wheel.

14. An electronic timepiece according to claim 4; wherein the control means is responsive to the indicator position judgement means when the analog display is enabled and is driven by drive pulses output by the drive pulse generating means such that when the time indicating member comes to a predetermined position as deleted by the indicator position judgement means, count information of the time counting means is reset.

15. An electronic timepiece according to claim 4; wherein the control means is responsive to reactivation of the display when the display is disabled to reset the count information of the time counting means and to control the pulse generating circuit to generate drive pulses to drive the time indicating member and the date indicating member.

* * * * *